US011560898B2

(12) United States Patent
Kosse et al.

(10) Patent No.: US 11,560,898 B2
(45) Date of Patent: Jan. 24, 2023

(54) FAN IMPELLER SYSTEM FOR CONFIGURING AND CONSTRUCTING A FAN IMPELLER

(71) Applicant: ebm-papst Mulfingen GmbH & Co. KG, Mulfingen (DE)

(72) Inventors: Marcus Kosse, Kuenzelsau (DE); Wenjie Song, Shanghai (CN); Eric Cheng, Shanghai (CN); Raven Qin, Shanghai (CN); Erhard Gruber, Satteldorf (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/408,444

(22) Filed: Aug. 22, 2021

(65) Prior Publication Data

US 2022/0065260 A1 Mar. 3, 2022

(30) Foreign Application Priority Data

Aug. 26, 2020 (DE) ..... 10 2020 122 318.8

(51) Int. Cl.
*F04D 29/18* (2006.01)
*F04D 19/00* (2006.01)

(52) U.S. Cl.
CPC ..... *F04D 29/181* (2013.01); *F04D 19/002* (2013.01)

(58) Field of Classification Search
CPC ..... F04D 29/181; F04D 19/002; F04D 29/34
See application file for complete search history.

(56) References Cited

U.S. PATENT DOCUMENTS 2,620,039 A * 12/1952 Allen ..... F04D 29/36 416/210 A
2004/0042903 A1* 3/2004 Huang ..... F04D 29/36 416/207
2018/0274549 A1* 9/2018 Baer ..... F04D 29/388

* cited by examiner

*Primary Examiner* — Aaron R Eastman
(74) *Attorney, Agent, or Firm* — Harness, Dickey & Pierce, P.L.C.

(57) ABSTRACT

A fan impeller system has a rotor element (10), a multiplicity of fan impeller blades (30) and a multiplicity of adapter elements (20). The rotor element (10) has a multiplicity of receptacles (11) that are evenly distributed in a circumferential direction (U) with an adapter element (20). The adapter element (20) is arranged between the respective fan impeller blade (30) and the respective receptacle (11). The adapter elements (20) may differ at least in their shape and/or dimensions. The fan impeller blades (30) may differ at least in their shape and/or dimensions.

10 Claims, 3 Drawing Sheets

FAN IMPELLER SYSTEM FOR CONFIGURING AND CONSTRUCTING A FAN IMPELLER

CROSS-REFERENCE TO RELATED APPLICATION

This application claims priority to German Patent Application No. 102020122318.8 filed Aug. 26, 2020. The entire disclosure of the above application is incorporated herein by reference.

FIELD

The disclosure relates to a fan impeller system for configuring and constructing a fan impeller for a predetermined application and to a fan impeller that has been constructed using such a fan impeller system.

BACKGROUND

A large number of different variants of fan impeller has been known for a long time in the art.

Mostly, however, a provision is made to provide a specific one-piece fan impeller or a specific multi-part fan impeller for one application or for a specific application. Thus, different fan impellers are provided for different applications and a large number of tools must be provided for their production. This results in high production costs and logistical challenges or problems, since the fan impellers, the parts, and the tools have to be stored and managed, which is costly.

The disclosure is therefore based on the object that the aforementioned drawbacks can be overcome and a wide variety of fan impellers can be provided in a simple manner for a wide variety of applications.

SUMMARY

This object is achieved by the combination of features including a fan impeller system, comprising a rotor element, a multiplicity of fan impeller blades and a multiplicity of adapter elements. The rotor element has a multiplicity of receptacles that are evenly distributed in a circumferential direction on an adapter element, from the multiplicity of adapter elements that can be arranged on each receptacles. A fan impeller blade, from the multiplicity of fan impeller blades, can be respectively arranged on an adapter element. The adapter element is arranged between the respective fan impeller blade and the respective receptacle. The respective fan impeller blade is connected to the rotor element by the adapter element. The adapter elements, from the multiplicity of adapter elements, can be selected from a group of adapter element types that differ at least in their shape and/or dimensions. The fan impeller blades, from the multiplicity of fan impeller blades, can be selected from a group of fans impeller blade types that differ at least in their shape and/or dimensions. A fan impeller that is suitable for a predetermined application can be configured by selecting an adapter element type that is suitable for the application, from the group of adapter element types, a fan impeller blade type that is suitable for the application, from the group of fan impeller blade types, and be constructed by mounting the adapter elements and the fan impeller blades on the rotor element.

According to the disclosure, a fan impeller system includes a rotor element, a multiplicity of fan impeller blades and a multiplicity of adapter elements. Two fan impeller blades or two adapter elements is already understood as a multiplicity. Since the rotor element is preferably designed both geometrically and functionally as a central element, it can also be referred to as a central rotor element that can be rotated about its central axis or about its axis of rotation. The rotor element has a multiplicity of receptacles that are uniformly distributed in its circumferential direction relative to its axis of rotation. Each one includes an adapter element of the multiplicity of adapter elements. Furthermore, a respective fan impeller blade, from among the multiplicity of fan impeller blades, can be arranged on an adapter element. Thus, the adapter element is or can be arranged between the respective fan impeller blade and the respective receptacle. The respective fan impeller blade is or can be connected to the rotor element by the adapter element. In addition, the adapter elements, from among the multiplicity of adapter elements, can be selected from a group of adapter element types that differ at least in their shape and/or dimensions. The fan impeller blades, from among the multiplicity of fan impeller blades, can be selected from a group of fan impeller blade types that differ at least in their shape and/or dimensions. Accordingly, a fan impeller that is suitable for a predetermined application can be configured by selecting an adapter element type that is suitable for the application for the adapter elements from among the multiplicity of adapter elements from the group of adapter element types. A fan impeller blade type that is suitable for the application for the fan impeller blades is from the multiplicity of fan impeller blades from the group of fan impeller blade types. It is constructed by mounting the adapter elements and the fan impeller blades on the rotor element.

A further aspect of the disclosure relates to a fan impeller that includes and/or is constructed using the system according to the disclosure and to a set of the individual components including and/or constructing such a fan impeller.

The basic idea of the disclosure is to be able to arrange different fan impeller blades on or at a rotor element. One side is designed to fit the rotor element or a standard rotor or a standard rotor element by the adapter element or by the respective adapter element. The other side is designed to fit the respective fan impeller blade.

In an advantageous refinement, the respective fan impeller blade can be releasably secured to the rotor element in a predetermined position and in a predetermined orientation or alignment by the adapter element. The adapter element, in an assembled state, is arranged between the fan impeller blade and the rotor element. Through the selection of an appropriate adapter element type, it can be determined how the fan impeller blade is aligned on the rotor element.

The fan impeller blades, from among the multiplicity of fan impeller blades, are of the same fan impeller blade type. Also, the adapter elements, from among the multiplicity of adapter elements, are of the same adapter element type. Thus, when the fan impeller is in the assembled state, a multiplicity of similar fan impeller blades are arranged on the rotor element. Each includes an adapter element that was selected from among a multiplicity of different types.

Particularly in an assembled state, an adapter element, with a fan impeller blade is respectively arranged on each of the receptacles of the rotor element. Alternatively, an adapter element, with a fan impeller blade, is respectively arranged on some of the receptacles of the rotor element. Regardless of whether fan impeller blades are provided on all or only some of the receptacles, they are evenly distributed over the circumferential direction of the rotor element and arranged thereon by at least the respective adapter element. Depending on the intended use or the selected type of fan impeller blade, it is possible for a fan impeller blade to be provided only on every other receptacle, for example.

In an advantageous variant, the adapter elements each have a blade side facing the respective fan impeller blade. Preferably, the rotor sides are oppositely situated and the rotor sides face the respective receptacle. Alternatively, the blade side and the rotor side, which lie particularly on a plane, can also have an angle between them. Thus, the adapter element can also be L-shaped, for example. The blade side is designed to correspond to a mounting surface of the respective fan impeller blade facing the respective adapter element. The rotor side is designed to correspond to a mounting surface of the respective receptacle facing the respective adapter element.

In another advantageous refinement of the system, first mutually corresponding coding elements are provided or formed on the mounting surface of the respective fan impeller blade and on the blade side of the respective adapter element. The blade side is formed substantially by a surface. In addition, second mutually corresponding coding elements are provided on the mounting surface of the respective receptacle and on the rotor side of the respective adapter element. The rotor side is formed substantially by another surface. In addition, the respective fan impeller blades can be arranged exclusively on the blade side of the adapter element by virtue of the first coding elements. The adapter element can be arranged with its rotor side exclusively on the receptacle by virtue of the second coding elements. Coding elements can also be formed by embodying the respective surfaces so as to be substantially flat so that they can rest against one another.

For example, different coding elements can be provided on each type of fan impeller. Thus, only certain types or a certain type of adapter element can be arranged on the respective type of fan impeller. The same also applies to the types of adapter element themselves. Thus, one type or only certain types of adapter element can be arranged on one or various types of fan impeller blade.

In general, by appropriately designing the coding elements on the fan impeller blades and/or the adapter elements or an interface formed by the same, a mix-up of the components during their assembly can be largely eliminated. As a result, the so-called poka-yoke method can also be implemented in order to reduce errors when assembling the fan impeller blades with the adapter elements or when assembling the fan impeller blades by the adapter elements on the rotor element.

Preferably, the blade side of the adapter element or of an adapter element from among the multiplicity of adapter elements, which lies substantially completely on a plane, it being possible for any existing coding elements to extend out of the plane, and a reference plane orthogonal to a rotation axis of the rotor element form a first angle between them. The rotor side of the adapter element or of an adapter element, from among the multiplicity of adapter elements, which lies substantially completely on a plane, it being possible for any existing coding elements to extend out of the plane, and the reference plane form a second angle between them. The first and/or the second angle differ at least in part between adapter element types. An angle of attack of the respective fan impeller blade on the rotor element is establishable or established by the first and/or second angle. Without the definition of a reference plane lying between the sides, these features can be simplified by having the blade side, which is substantially on a plane, and the rotor side form an angle between them. This determines the angle of attack of the respective fan impeller blade mounted on the adapter element. A general consequence of the first and second angles, more particularly of the angle between the blade side and the rotor side, is that the adapter elements are preferably each wedge-shaped. The angle of attack of the associated fan impeller blade can be determined and selected by choosing adapter elements with a suitably formed wedge shape. Thus, without the need to make additional changes to the motor technology or the electronics of a fan with the fan impeller that has been constructed or provided in this way, it is possible to produce additional working points (operating points) for the applications or use in different end devices or even in the same end device.

If the interfaces have the same design, it is also possible for the wedge-shaped configuration of the adapter element or adapter elements to be used only in order to be able to adjust the angle of attack without having to manufacture a new fan impeller blade, provided that the aerodynamics of the fan impeller blade allow this. Accordingly, it is advantageous here if the respective fan impeller blade or the type of fan impeller blade used can be used for different angles of attack or within a range of angles of attack.

In order to enable the fan impeller blades to be secured to the rotor element, the system also has a multiplicity of fastening elements. A fastening element is provided on each fan impeller blade by means of which the respective fan impeller blade can be or, in the assembled state, is preferably detachably connected to the respective adapter element and the respective receptacle.

A single fastening element or, alternatively, a plurality of fastening elements can be provided for each fan impeller blade. Screws can be used as fastening elements, for example.

A variant is also advantageous where the fastening element is embodied, for example, as a latching element of the respective receptacle or of the respective fan impeller blade. It is designed to secure the respective adapter element and the respective fan impeller blade to the rotor element. Alternatively, the fastening element is formed by the adapter element. It has at least one first sub-element and at least one second sub-element. The first sub-element is designed to secure the respective fan impeller blade to the adapter element. The second sub-element is designed to secure the adapter element on the receptacle. The first and second sub-elements can each, in turn, be instantiated as a latching element, for example. The first sub-element can also be formed on the fan impeller blade and/or the adapter element. The second sub-element can also be formed on the adapter element and/or the rotor element. Furthermore, the fastening elements can be provided or instantiated integrally as coding elements.

Depending on the type, for additional alignment and securement of the fan impeller blades, they can additionally have a pin. The pin extends in the radial direction relative to the axis of rotation of the rotor element and corresponds to a receptacle provided on the rotor element. The respective fan impeller blade can be rotated, for example, in an angular range the pin. Thus, it is possible for the exact angle to be determined by the respective adapter element.

In order to be able to ensure a secure connection of the fan impeller blades to the rotor element by the adapter elements, the fan impeller blades can each have a, preferably, metallic insert element, particularly also depending on the respective type. The respective insert element is designed to be brought to bear on the respective adapter element. Thus, it is possible for the respective fan impeller blade to be secured to the insert element with the adapter element and/or the rotor element. In particular, the fan impeller blade or the fan impeller blades of a type of fan impeller blade, with an insert element, can be formed from two components. Thus, a blade portion of the fan impeller blade is made of plastic and a connecting portion of the fan impeller blade is made of metal.

Another aspect of the disclosure relates to a fan with a fan impeller that has been constructed or provided according to the system and to an electric motor that drives the fan impeller about an axis of rotation or about the axis of rotation of the rotor element, that includes a stator and a rotor. Thus, it is possible for the rotor of the electric motor to be arranged in the rotor element of the fan impeller and/or formed integrally with it.

The features disclosed above can be combined as required, provided this is technically possible and they do not contradict one another.

Further areas of applicability will become apparent from the description provided herein. The description and specific examples in this summary are intended for purposes of illustration only and are not intended to limit the scope of the present disclosure.

DRAWINGS

Other advantageous refinements of the disclosure are characterized in the subclaims and/or depicted in greater detail below together with the description of the preferred embodiment of the disclosure with reference to the figures. In the drawings:

DETAILED DESCRIPTION

The figures are schematic examples. Same reference symbols in the figures indicate same functional and/or structural features.

FIGS. 1 to 5 show different views of a fan impeller 1 in an assembled state; according to the various representations. Not all features are visible in all figures even though they are present in each case.

Figure 1:
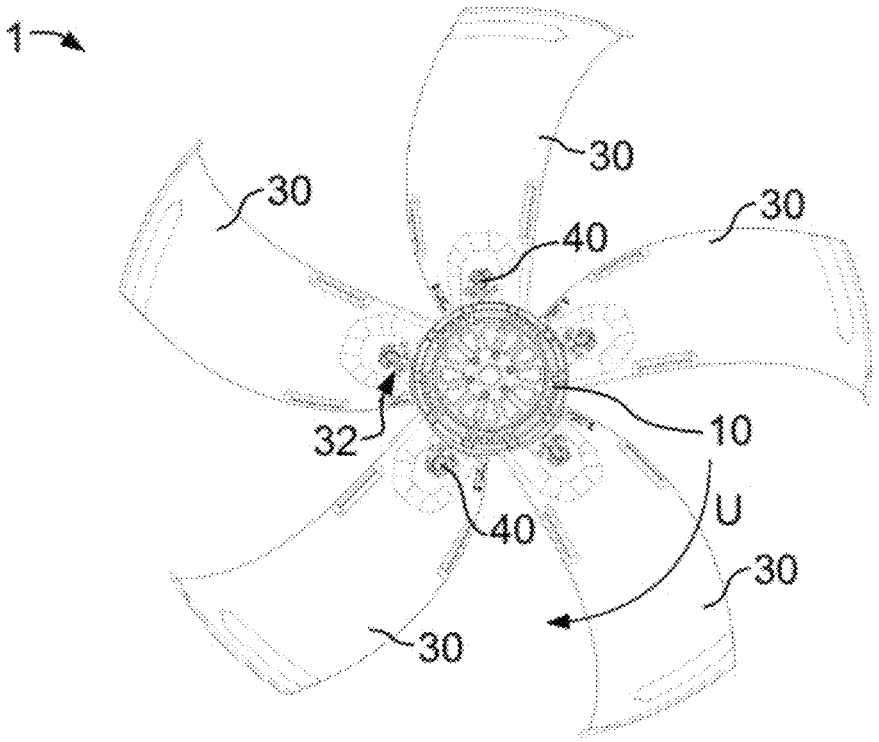
FIG. 1 is a plan view of a fan impeller from above.

The centrally arranged rotor element 10, with the fan impeller blades 30 arranged in its circumferential direction U, is particularly visible in the plan view shown in FIG. 1. Each of the fan impeller blades 30 is connected to the rotor element 10 by the adapter elements 20 and the receptacles 11 of the rotor element 10 by a fastening element 40, that is instantiated as a screw. The metallic insert elements 32 are visible here. One insert element 32 is provided for each fan impeller blade 30 and cast into a plastic material of the fan impeller blade 30. The side of the insert element 30 facing away from the adapter element 20 serves as a support surface for the screw head of the screw provided as the fastening element 40.

The view from below shown in FIG. 2 additionally and particularly shows the receptacles 11 that are formed by the rotor element 10. Each one has a fastening portion 13, provided here as a threaded portion, that interacts with the fastening element 40. The adapter elements 20 are arranged between the respective mounting surface 31 of the fan impeller blade 30 facing the receptacle 11. The mounting surface 12 of the receptacle 11, faces the fan impeller blade 30, and is largely concealed in FIG. 2 by the respective receptacle 11. The receptacle 11 is embodied as a projection, and are only sporadically visible.

In the variant of the figures that is shown by way of example, five receptacles 11 and five fan impeller blades 30 are provided on the rotor element 10. Thus, the fan impeller 1 is formed as a result has five blades. Due to the odd number of receptacles 11, all receptacles 11 must each be provided with a fan impeller blade 30 and an associated adapter element 20. Thus, the fan impeller blades 30 are arranged uniformly in the circumferential direction U. If, as an alternative, an even number of receptacles 11 is provided on the rotor element 10, then only every other receptacle 11 can be provided with a fan impeller blade 30, for example.

Figure 2:
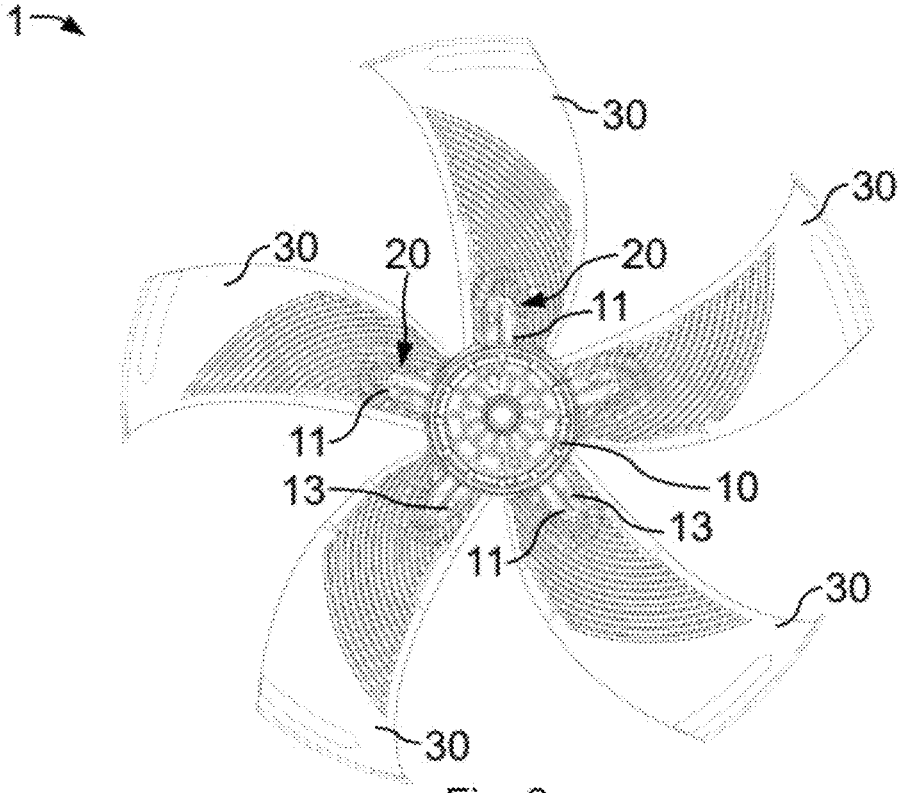
FIG. 2 is a plan view of the fan impeller from below.

As can be clearly seen in FIGS. 1 and 2, the respective end portion of the fan impeller blades 30, facing the rotor element 10, is designed to correspond to a shape of the rotor element 10, more particularly so as to be concave. Thus, the fan impeller blades 30 abut with their end portion pointing inward in the radial direction on the rotor element 10 or have only a small gap. This is dependent particularly on a selected angle of attack and thus on the adapter element 20 used in each case.

Figure 3:
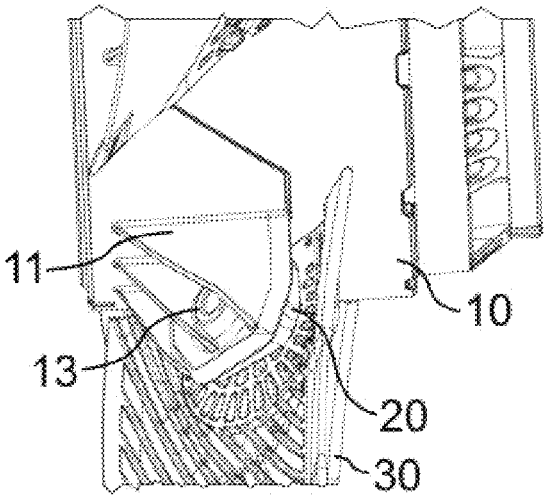
FIG. 3 is a partial side perspective view of the fan impeller.

In the side view of the fan impeller 1 as shown in FIG. 3, it can be seen in particular that the rotor element 10 can be constructed from a plurality of parts. The receptacle 11 extends out of the central and preferably rotationally symmetrical portion of the rotor element 10 and has a plurality of ribs for reinforcement.

Figure 4:
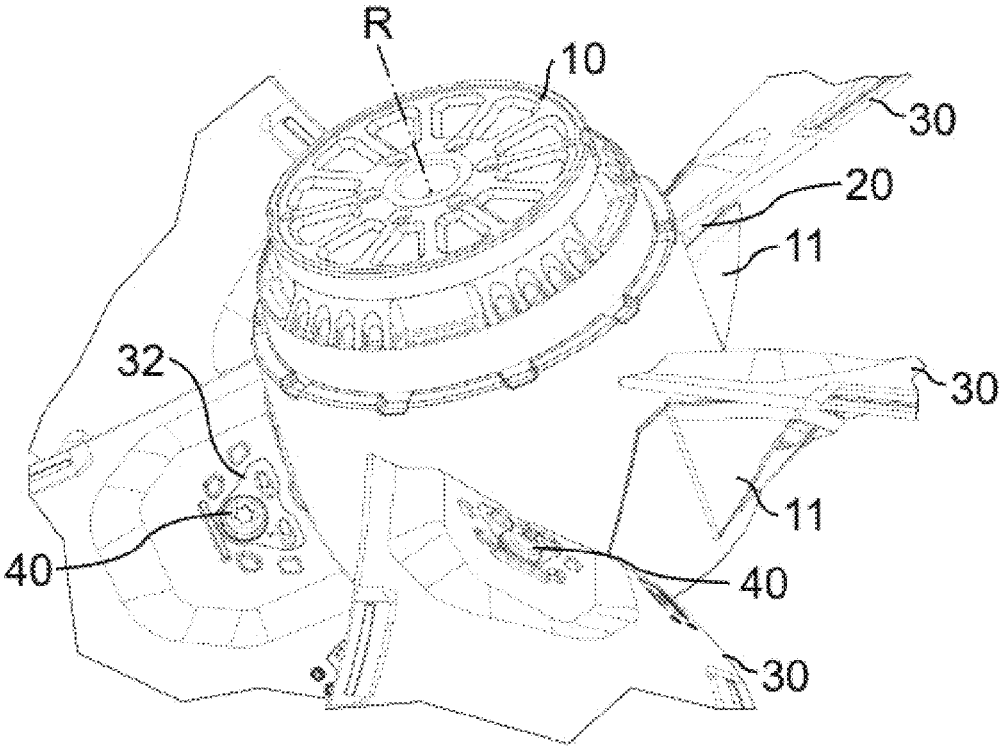
FIG. 4 is a partial perspective view of the fan impeller.

In FIG. 4, the area around the rotor element 10 of the fan impeller 1 is shown in a cutout, perspective view that is enlarged compared to the previous figures. The receptacles 11 each extend in the radial direction away from the axis of rotation R out of the central and rotationally symmetrical portion of the rotor element 10. The respective mounting surfaces 12 of the receptacles 11, facing the respective adapter elements 20, are tilted relative to an imaginary reference plane that is arranged orthogonally to the axis of rotation R. Thus, the fan impeller blades 30 arranged thereon are approximately in a desired position or within a predetermined tolerance range. The blades 30 can then be precisely adjusted by means of the respectively selected adapter elements 20. Thus, the fan impeller blades 30 are arranged on the rotor element 10 in the predetermined alignment and/or orientation and, in particular, with at a desired angle of attack.

Figure 5:
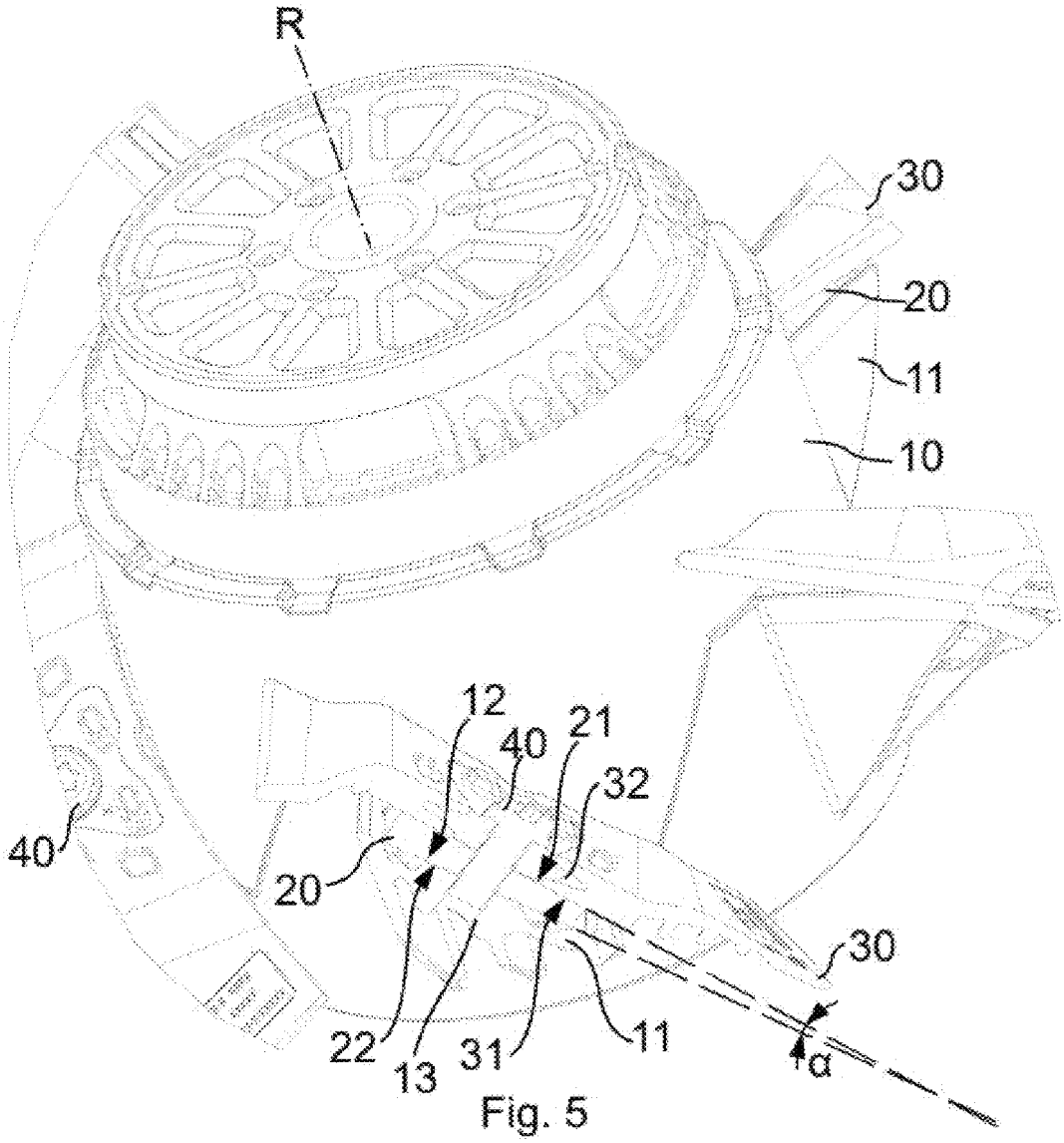
FIG. 5 is a cross section view through a fan impeller.

FIG. 5 also shows a section through one of the receptacles 11 with a fan impeller blade 30 mounted thereon by a fastening element 40 with an adapter element 20 lying therebetween.

For the sake of clarity, the cut surfaces are not shown with hatching.

Due to the tilting of the mounting surface 12 of the receptacle 11 relative to the imaginary reference plane that is orthogonal to the axis of rotation R, the fan impeller blade 30 secured thereon already assumes a known orientation relative to the reference plane or relative to the rotor element 10. In order to set the angle of attack of the fan impeller blade 30 exactly, a corresponding type of adapter element is selected where the rotor side 22 and the blade side 21 of the respective adapter elements 20, which sides respectively lie substantially on a plane, form an angle $\alpha$ through which the fan impeller blade assumes the desired angle of attack.

The sectional representation in FIG. 5 also shows that the insert element 32 is cast into the fan impeller blade 30. It forms a support surface for the screw that is provided as the fastening element 40 toward the top or on the side facing away from the adapter element 20. A high surface pressure or force can be applied by means of the screw and the insert element 32 without damaging the fan impeller blade 30.

The disclosure is not limited in its execution to the abovementioned preferred exemplary embodiments. Rather, a number of variants are conceivable that make use of the illustrated solution even in the form of fundamentally different embodiments.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fan impeller system, comprising:

a rotor element, a multiplicity of fan impeller blades and a multiplicity of adapter elements;

the rotor element has a multiplicity of receptacles that are evenly distributed in its circumferential direction, a respective mounting surface of the receptacle is tilted relative to an imaginary plane that is arranged orthogonally to a central axis of rotation of the rotor element, an adapter element, from the multiplicity of adapter elements, can be arranged on each receptacle;

a fan impeller blade, from the multiplicity of fan impeller blades, can be respectively arranged on an adapter element, the adapter element is arranged between the respective fan impeller blade and the respective receptacle and the respective fan impeller blade is connected to the rotor element by the adapter element;

the adapter elements, from the multiplicity of adapter elements, are selected from a group of adapter element types that differ at least in their shape and/or dimensions, and the fan impeller blades, from the multiplicity of fan impeller blades, are selected from a group of fans impeller blade types that differ at least in their shape and/or dimensions;

and a fan impeller that is suitable for a predetermined application can be configured by selecting an adapter element type that is suitable for the application from the group of adapter element types and a fan impeller blade type that is suitable for the application from the group of fan impeller blade types is such that at least one of the adapter elements is different from the other adapter elements and can be constructed by mounting the adapter elements and the fan impeller blades on the rotor element.

2. The system as set forth in claim 1, wherein the respective fan impeller blade can be releasably secured to the rotor element in a predetermined position and in a predetermined orientation by the adapter element, which can be arranged between the fan impeller blade and the rotor element.

3. The system as set forth in claim 1, wherein the fan blades, from the multiplicity of fan blades, are of the same fan blade type, and the adapter element, from the multiplicity of adapter elements, are of the same adapter element type.

4. The system as set forth in claim 1, wherein an adapter element with a fan impeller blade is respectively arranged on each of the receptacles of the rotor element, or an adapter element with a fan impeller blade is respectively arranged on some of the receptacles of the rotor element, and wherein the fan impeller blades are evenly distributed over the circumferential direction of the rotor element and are arranged thereon by at least the respective adapter element.

5. The system as set forth in claim 1, wherein the adapter elements each have a blade side facing the respective fan impeller blade and a rotor side facing the respective receptacle, and the blade side corresponds to a mounting surface of the respective fan impeller blade facing the respective adapter element and the rotor side corresponds to the respective mounting surface of the respective receptacle facing the respective adapter element.

6. The system as set forth in claim 5, wherein the blade side of the adapter element and a reference plane orthogonal to an axis of rotation of the rotor element form a first angle between them, and the rotor side of the adapter element and the reference plane form a second angle between them, and wherein the first and/or the second angle differ between adapter element types, and an angle of attack of the respective fan impeller blade on the rotor element is established by the first and/or second angle.

7. The system as set forth in claim 1, further comprising a multiplicity of fastening elements, wherein a fastening element is provided on each fan impeller blade wherein the respective fan impeller blade can be connected to the respective adapter element and the respective receptacle.

8. The system as set forth in claim 7, wherein the fastening element is formed by the respective receptacle or the respective fan impeller blade and secures the respective adapter element and the respective fan impeller blade on the rotor element, or the fastening element is instantiated by the adapter element and has at least one first sub-element and at least one second sub-element, the first sub-element secures the respective fan impeller blade to the adapter element, and the second sub-element secures the adapter element to the receptacle.

9. The system as set forth in claim 1, wherein the fan impeller blades each have an insert element that is designed to be brought to bear on the respective adapter element and secure the respective fan impeller blade with the adapter element and/or the rotor element.

10. A fan with a fan impeller constructed according to the system in claim 1, and an electric motor that drives the fan impeller about an axis of rotation and has a stator and a rotor, the rotor of the electric motor arranged in the rotor element of the fan impeller and/or formed integrally therewith.

* * * * *